US005839317A

United States Patent [19]

Rosenfield

[11] Patent Number: 5,839,317

[45] Date of Patent: Nov. 24, 1998

[54] AUTOMATED BECKER HAMMER DRILL BOUNCE CHAMBER ENERGY MONITOR

[75] Inventor: Jack Rosenfield, Lakewood, Colo.

[73] Assignee: The United States of America as represented by the Secretary of the Interior, Washington, D.C.

[21] Appl. No.: 673,763

[22] Filed: Jun. 14, 1996

[51] Int. Cl.[6] ..... B25D 9/00

[52] U.S. Cl. ..... 73/784

[58] Field of Search ..... 73/84, 784, 12.09

[56] References Cited

U.S. PATENT DOCUMENTS 3,721,095 3/1973 Chelminski .
4,383,582 5/1983 Chelminski .
4,977,965 12/1990 Rupe .

*Primary Examiner*—Robert Raevis
*Attorney, Agent, or Firm*—E. Philip Koltos

[57] ABSTRACT

A system and method for providing analysis and evaluation of penetration test data for modifying Becker Hammer drill programs while in progress by measuring the bounce chamber pressure of a diesel hammer. The system comprises a pressure transducer connected to the bounce chamber for sensing the bounce chamber pressure, a data logger for monitoring the pressure transducer, storage means, a control module and a keyboard having a display screen to enable user control of the data logger, a telephone modem, and a series of instructions for controlling the schedule, pressure transducer measurement, control module signal monitoring, computation of data, and data storage operations of the data logger.

10 Claims, 4 Drawing Sheets

AUTOMATED BECKER HAMMER DRILL BOUNCE CHAMBER ENERGY MONITOR

BACKGROUND OF THE INVENTION

1. Field of the Invention

This invention relates generally to novel data gathering and sampling in connection with in-situ soil testing and analysis. More particularly, the invention concerns a method and apparatus for providing analysis and evaluation of Becker Penetration Test Data more accurately and timely to be used immediately to modify drilling programs while in progress.

2. Discussion of the Prior Art

In the past, it has been common practice to extract soil samples and make laboratory measurements of data concerning the characteristics of a soil bed on the recovered samples. While some arrangements have exhibited at least a degree of utility in the gathering of data in connection with soil mechanics analysis, room for significant improvement remains.

There are many cases in engineering practice where it is necessary to determine the engineering characteristics of gravelly and course-grained soils. Desirably, this would be done in-situ, since the properties of cohesionless soils are known to be influenced significantly by sample disturbance. However, standard methods of in-situ exploration developed for sands, such as the Standard Penetration Test (PST), the Cone Penetration Test (CPT), the self-boring pressuremeter, etc. give erroneous results in gravels because the soil particles are large compared to the dimensions of the test equipment. Furthermore, determining soil properties by laboratory testing is hampered by the fact that it is virtually impossible to take undisturbed samples of gravelly soils, except by in-situ freezing techniques, and these are enormously expensive.

In consequence, the engineering properties of gravels are more customarily determined by constructing test pits to extract samples for grain size distribution tests and for determining the in-situ density or relative density of the gravelly soil. Representative samples are then prepared in the laboratory to the same density as that of the field deposits and used to determine engineering properties such as strength, deformation, and compressibility characteristics. Alternately, the engineering properties of the deposit are assessed on the basis of judgment, based on a knowledge of the grain distribution and the density of the deposit. Only occasionally has in-situ testing been attempted or used for engineering property determinations of gravelly soils.

In many cases the above procedures have provided useful data for design studies. However, care must be exercised to insure that all relevant factors influencing the interpretation of the test data obtained from the reconstituted samples are considered in the final evaluation of properties. This involves consideration of changes in density, if it is necessary to change the gradation by scalping or adopting a parallel gradation curve for preparation of laboratory test specimens, and in some cases, consideration of other effects such as "aging", which is likely to change the properties of any cohesionless soil over a long period of time.

In recent years, it has been found necessary to explore other properties of gravelly deposits, in addition to the conventional determinations of strength, deformation and compressibility characteristics. These include the response of gravelly deposits to cyclic loading, which may be induced by earthquake shaking or water action. It is only recently that the need for such studies and determination has been recognized. Some years ago it was the conventional wisdom of the goetechnical engineering profession, for example, that gravelly soils were not susceptible to large increases in pore water pressure, leading possibly to liquifaction, under the effects of earthquake shaking. It was generally believed that gravelly soils, because of their high permeability, would be able to dissipate pore pressures virtually as fast as they could be generated by earthquake shaking, and thus were not vulnerable to liquefaction during earthquakes. Clearly, this depends on the nature of the soil (sandy gravels for example, may not be significantly more pervious than sands); pore pressure dissipation also depends on the boundary drainage conditions since a gravel is not freedraining if it is underlain and overlain by relatively impervious layers of other soils.

The concept that gravels were not vulnerable to liquifaction was also fostered by the better field performance of foundations on gravel, as compared with sands, in earthquakes such as the Alaska earthquake of 1964, and by laboratory tests, conducted under cyclic loading conditions, which showed that significantly higher stresses were required, even under undrained cyclic loading conditions, to induce high pore water pressures in gravelly soils than in sands. It has since been recognized that the higher laboratory strengths were due mainly to the effects of membrane compliance, and that when laboratory test results are corrected for this effect, the cyclic loading resistance of gravels is not very different from that for sands.

Finally, and more importantly, there have been a number of cases in recent years where liquifaction of gravelly deposits has been observed to occur, with associated effects, during earthquakes. These events have prompted a review of earlier earthquake performance of gravelly soils and several cases of earthquake-induced liquifaction in gravelly soils are now recognized to have occurred.

In a number of these cases, the generation of soil "blows" at the ground surface showed that particles up to one inch size had been carried upward by flowing water, or that sand was washed out of sandy gravel deposits to form sand boils at the surface.

Recognition of these effects has led to a renewed interest in the liquifaction characteristics of gravelly soils and in methods of field exploration which can lead to meaningful determinations of their in-situ characteristics. Since the nature of gravelly soils is likely to involve many of the same problems in geotechnical investigations as sands, i.e., significant variability within relatively short distances and significant changes in properties due to sample disturbance, it has seemed desirable to explore the possibility of exploring the properties of gravelly soils using procedures which have proved successful for sandy soils; that is by the use of some type of penetration test which can be performed rapidly, at a number of locations in a deposit, to provide a representative index of overall characteristics. Clearly such a test would need to be much larger in scale than the relatively small-scale SPT or CPT tests used widely for investigating the liquefaction resistance and other properties of sands. In fact, a large scale version of either of these tests would seem to provide a useful basis for investigating the characteristics of gravelly soils. An added advantage of such an approach is that a large-scale version of, say, the SPT test should be just as applicable in sands as the conventional SPT test and thus it should be possible to correlate the results of the test results with the extensive body of field performance data, such as liquifaction resistance and compressibility, through the development of correlations between the different test procedures. This would provide a direct basis for evaluating the field behavior of gravelly soils.

Fortunately, such a large-scale type of penetration test already exists in the form of the Becker Penetration Test, developed in Canada in the later 1950's and now widely used for exploring the characteristics of deposits containing gravel and cobble-size particles.

Present methods and apparatus for measuring the ability of a soil bed to support a structure are limited in several ways. First, there are no known methods or apparatus that measure the dynamic loading characteristics of a soil bed as a function of time. Moreover, present methods and apparatus utilize short displacement, cyclic, linear penetration techniques that penetrate a soil bed at a constant rate and do not measure the dynamic loading characteristics of the soil.

One prior art device is shown in U.S. Pat. No. 5,339,679 to Ingram et al discloses a self-contained apparatus for determining the static and dynamic loading characteristics of a soil bed. In operation, a drill string presses the apparatus into a soil bed at an uncontrolled rate resulting in a variable penetration rate. The apparatus has a self-contained data acquisition system that measures and records, as a function of time, the force exerted on the sampling apparatus and the depth of penetration as the drill string presses the sampling apparatus into the soil bed. Data is provided that enables the user to determine the static soil characteristics (e.g., shear strength and stress-strain characteristics) and the dynamic loading characteristics of the soil bed.

U.S. Pat. No. 4,542,639 to Cawley et al discloses apparatus and method for testing structures by impact. The structure is struck by an impacter associated with a force transducer, the output of which is related to the force which the transducer experiences on impact and encompasses a frequency range including the lowest frequencies (typically approaching zero frequency) which that force contains to any substantial degree. A test spectrum of the force including that full range of frequencies is produced by a Fourier transformer in a form suitable for automatic comparison, and is than compared with a reference spectrum typical of impact with a reference structure, and a signal is produced indicating fit or lack of fit between the test and reference spectra.

U.S. Pat. No. 5,048,320 to Mitsuhashi et al and U.S. Pat. No. 5,195,364 to Dehe et al disclose methods and apparatus for testing the hardness of objects or structures using non-destructive impact to an object to be inspected.

The problems enumerated in the foregoing are not exhaustive but rather are among many which tend to impair the effectiveness of previously known testing devices and data gathering systems.

SUMMARY OF THE INVENTION

The present invention addresses the problems described above by providing a method and apparatus for providing analysis and evaluation of Becker Penetration Test Data more accurately and timely to be used to modify drilling programs while in progress. The data logger monitors the bounce chamber pressure by use of a pressure transducer connected in line with, and adjacent to, the monitoring gauge. Locating the pressure transducer adjacent to the monitoring gauge ensures that the recorded pressure is the same as the visually monitored pressure and that any effect of hose length is the same for both automated and manual monitoring. Since the bounce chamber pressure is cyclical, and the primary interest is the peak pressure for each hammer blow, the data logger repeatedly measures the transducer pressure, selects the peak pressure for each hammerblow, and stores the peak pressure along with the date and time of each blow in the data logger memory.

BRIEF DESCRIPTION OF THE DRAWINGS

FIG. 2 is a schematic diagram of a Becker Hammer Drill sampling operation while

DESCRIPTION OF THE PREFERRED EMBODIMENT

Figure 1:
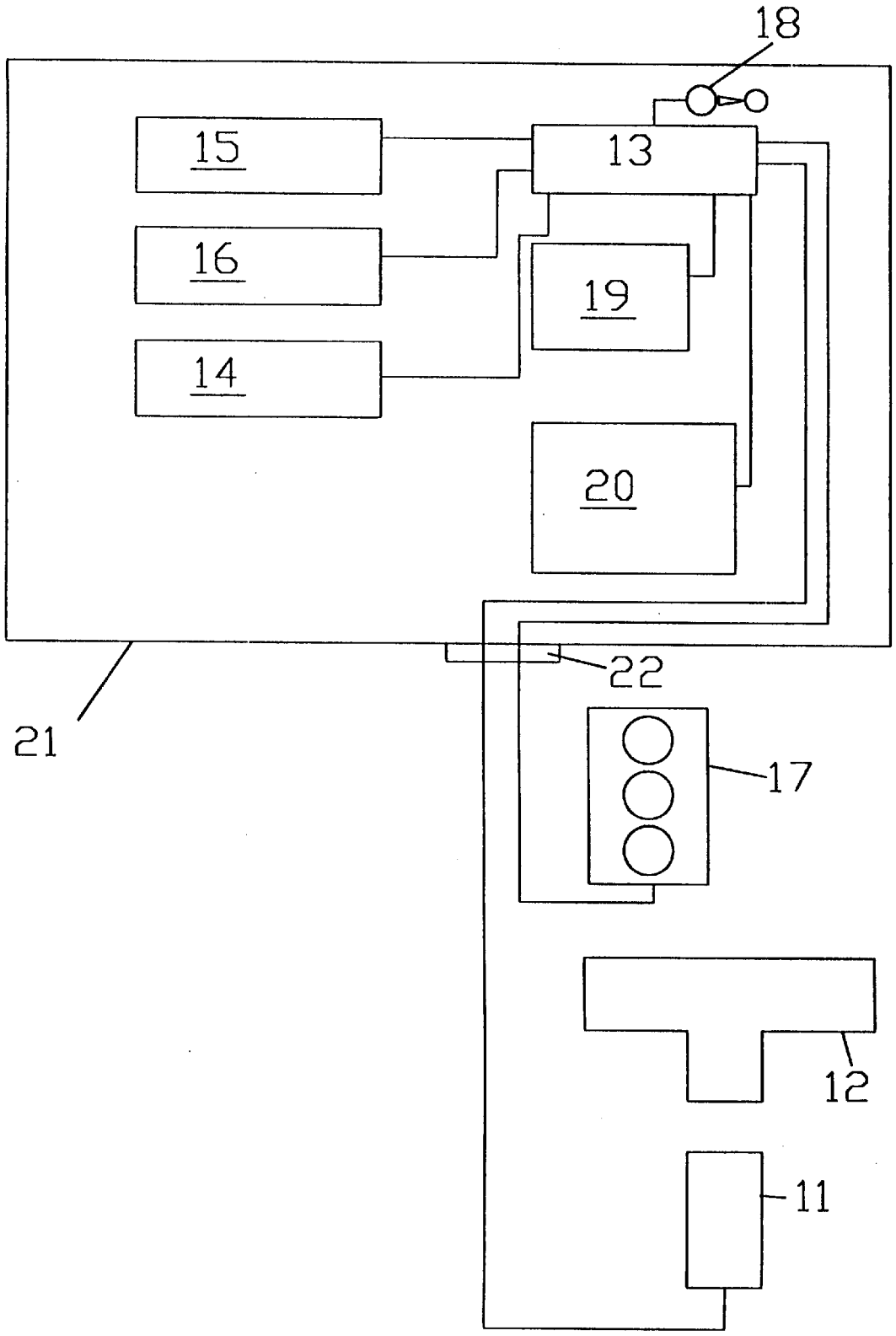
FIG. 1 is a schematic view of the bounce chamber energy monitor of the invention.
Figure 2:
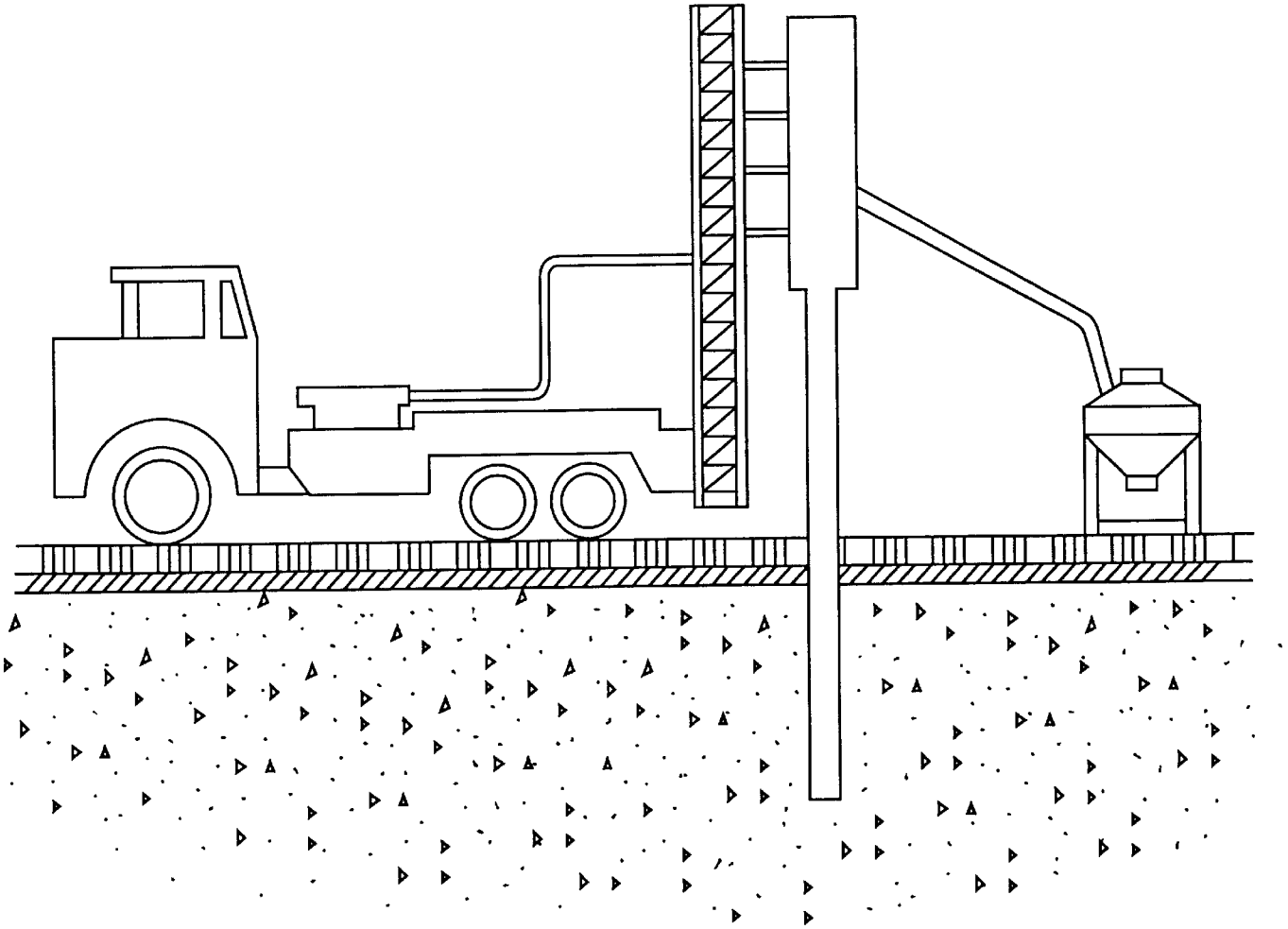
FIG. 2 PRIOR ART
Figure 2B:
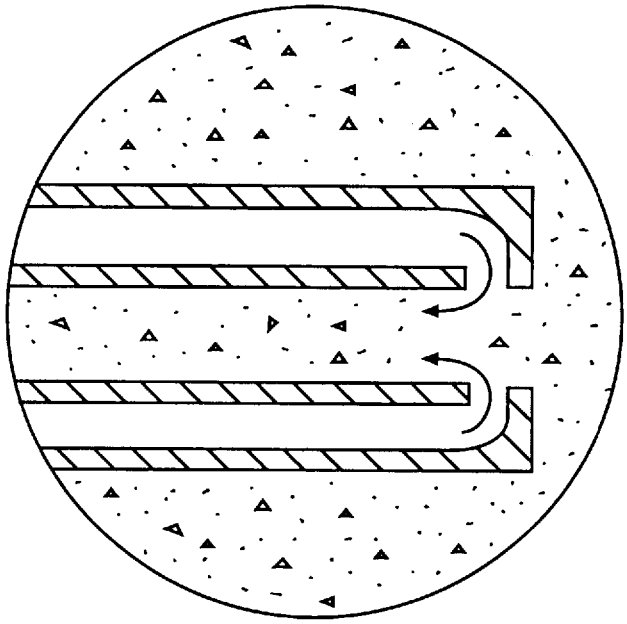
FIG. 2B PRIOR ART
FIGS. 2A and 2B show details of FIG. 2.
Figure 2A:
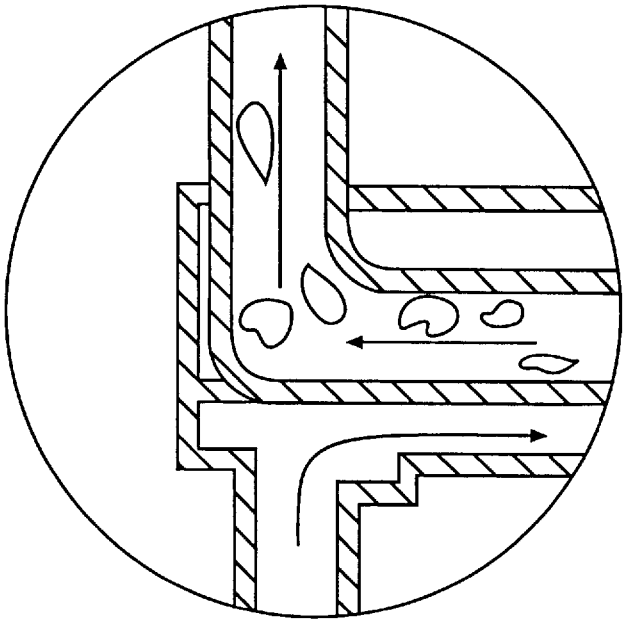
FIG. 2A PRIOR ART
Figure 3:
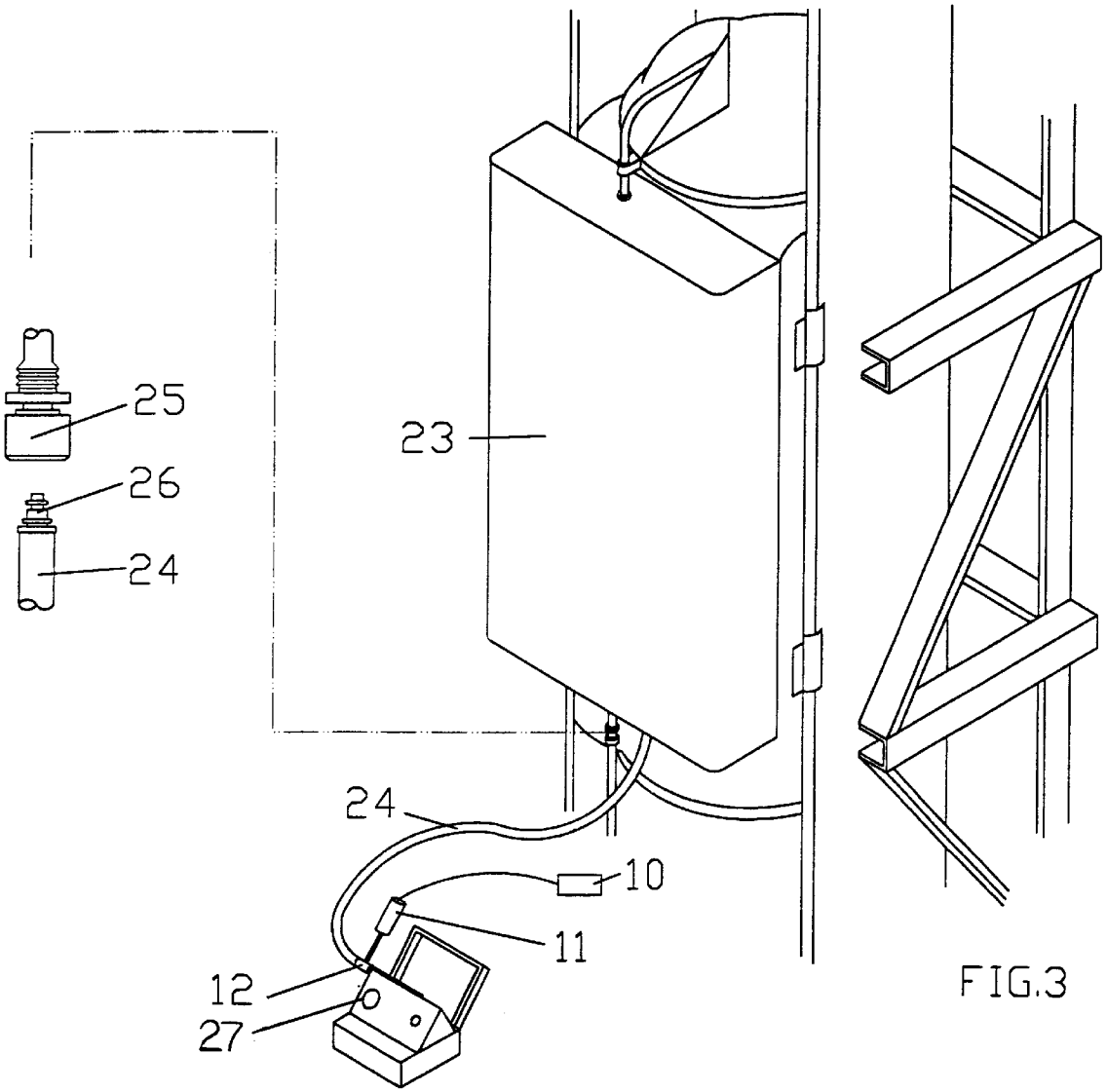
FIG. 3 is a schematic diagram of a typical output energy rating instrument showing the location of the bounce chamber energy monitor of the invention.

The Becker Hammer Drill, shown in FIG. 2, was developed by Becker Drills during the late 1950's as a method for rapidly penetrating deposits of gravels and cobbles. The method consists of driving a double-walled casing into the ground with a double-acting diesel pile hammer. During driving, air is forced down the annulus of the casing system to the drive bit as shown in FIGS. 2A and 2B. Soil particles entering the bit (FIG. 2B) are then transported up the inner casing (FIG. 2B) to the surface (FIG. 2A) by the air flow and they are then collected in a cyclone as illustrated in FIG. 2.

The diesel hammer used on Becker drill rigs is rated at a maximum energy of 8100 foot-pounds per blow. This type of pile hammer is closed off at the top and part of its energy during driving is developed by the compression of air in the top of the hammer cylinder during the travel of the ram during each cycle. By measuring the pressure of this trapped air pressure (bounce chamber pressure), in bounce chamber 23, an estimate of the driving energy can be obtained for each blow. Correlations between potential hammer energy and bounce chamber pressure have been developed by the manufacturer.

The hammer frame is mounted on rollers or wear blocks which move along guides on the drill rig mast. Delivering 92 blows per minute, it is not unusual for the hammer to achieve penetration rates of about 100 feet per hour. On completion of each sounding, the casing is gripped with tapered slips and raised by hydraulic grips. It usually requires about 60 minutes to withdraw 100 feet of casing from the ground.

The double walled casing is composed of two heavy pipes arranged concentrically (FIG. 2B). The inner pipe floats inside the outer pipe, separation being provided by neoprene cushions, and only the outer pipe absorbs the direct impact of the hammer. The casing is provided in 8 to 10 foot lengths, and segments are connected with threaded joints in the outer pipe. An "O" ring seal is used on one end of each inner pipe segment to avoid leaks between the outer and inner pipes.

The Becker Penetration Test consists basically of counting the number of hammer blows required to drive the casing one foot into the ground. By counting blows for each foot of penetration, a more or less continuous record of penetration resistance can be obtained for an entire soil profile. This test was originally called the "Becker Denseness Test" and was developed in Canada by using a plugged 8-tooth crowd-out bit with 5.5-inch O.D. casing. The plugged bit was employed because it was found that open-bit soundings in saturated sands often gave erratic results. Over the years, however, Becker penetration testing has employed both open and plugged bits together with both 5.5-inch and 6.6-inch O.D. casing sizes.

On a number of investigations, the Becker Penetration Test has often been used for the purpose of obtaining equivalent Standard Penetration Test (SPT) blowcounts and using correlations between SPT resistance and field behavior to predict performance. During the last 13 years, several correlations between Becker blowcounts and (SPT) blowcounts have been developed. The great variability of Becker-SPT correlations is due in large measure to the fact that the different studies often employed different Becker and SPT procedures and equipment, as well as different methods of data interpretation.

The studies do indicate that the penetration resistance measured by the Becker Drill procedure has the potential for development as an index of soil penetrability and that if tests were performed under suitably standardized conditions, a useful correlation between SPT and the Becker Test blowcounts could be developed.

Use of the automated Becker Hammer Bounce Chamber Pressure Monitor of the invention, designated by the numeral 10, to monitor bounce chamber pressure for the Becker Penetration Test was initially performed to improve the quality of data obtained during a typical test, and to enable test data to be evaluated at the test site enabling the test program to be altered if required. Prior to use of the automated monitor 10, an observer was required to count the number of hammer blows for each one foot interval of casing penetration, and observe the monitoring gauge to record the average peak pressure for all of the hammer blows in that interval. Monotony, high blowcounts, or variances in pressure within each interval often resulted in errors in recording the data. Furthermore, the recorded data required additional handling to enable input into the computer programs for analysis. Use of the monitor 10 eliminated these problems by recording bounce chamber 23 pressure for each hammer blow, and computing an average bounce chamber 23 pressure and standard deviation for each one foot interval. Recorded data is immediately available for analysis and is in a format suitable for input into computer programs for further analysis.

The monitor 10 consists of a pressure transducer 11, quick connect manifold 12, data logger 13, storage devices 15 and 16 weatherproof control module 17, indicator lamp 18, keyboard 19, and telephone modem 20. The components of the monitor 10 are housed in a weatherproof storage case 21 and powered by a battery 14. The Becker Hammer bounce chamber 23 is connected to the monitor 10 through socket 25, plug 26, through hose 24 to "Tee" 12 with quick connect couplings. Pressure transducer 11 is connected from the "Tee" 12 through weatherproof connectors 22 to the data logger 13.

In a preferred embodiment, the pressure transducer 11 had a range of 0–50 psi, with an output of 4–20 mA. Transducer 11 was a model 27-142-1050 manufactured by Keller PSI, Hampton, Va. 23666. Data logger 13 was a model CR10, storage modules 15, 16 were models SM192 and SM716, keyboard display 19 was a model CR10KD, telephone modem 20, was a model DC112. Additional components (not shown) are power supply, model BPALK; optically isolated RS-232 interface, model SC32A; 9 pin peripheral to RS-232 interface, model SC 532; data logger 13 support software, model PC 208; and cables model SC12. All of these units were supplied by Campbell Scientific, Inc., Logan, Utah. Control pod 17 was fabricated from a Woodhead Pushbutton Station, Model 4023, manufactured by Daniel Woodhead, Co., Aurora, Colo. Enclosure 21 was a model 827, manufactured by Underwater Kinetics, San Marco, Calif. The connectors were supplied by Newark Electronics of Denver, Colo., or Warren Fluid Power, of Denver, Colo.

The monitor 10 is controlled by a program containing a series of instructions which control the schedule, pressure transducer 11 measurement, control module signal monitoring, computation of data, and data storage operations of the data logger 13. The program is described in Appendix I to the specification. The data logger 13 monitors the bounce chamber 23 pressure by use of a pressure transducer 11, connected in line with, and adjacent to the monitoring gauge 27. Locating the pressure transducer 11 adjacent to the monitoring gauge 27 ensures that the recorded pressure is the same as the visually monitored pressure and that any effect of hose 24 length is the same for both automated and manual monitoring. Since the bounce chamber 23 pressure is cyclical and we are interested in the peak pressure for each hammer blow, the data logger 13 repeatedly measures the transducer 11 pressure, selects the peak pressure for each hammer blow. and stores the peak pressure along with the date and time of each blow in the data logger 13 memory 15 and 16.

The operator is required to depress a switch on the keyboard 19 or control module 17 to signal the data logger 13 for each one foot of casing penetration. This signal causes the data logger 13 to compute the blowcount, and the average and standard deviation of the pressure peaks for the previous foot of penetration. This penetration, as well as the date, time, and depth of penetration is stored in the data logger 13 memory. The operator is also required to depress a switch on the keyboard 19, or control module 17 to signal the data logger 13 to indicate the completion of a drill hole.

The data logger 13 monitors the pressure transducer 11 signal sixty four times per second. At a Becker Hammer rate of ninety two blows per minute, the pressure is measured about forty two times per blow, and thus the accuracy of the measured pressure is expected to be less than the estimated 0.5 psi accuracy of visual observations. The data logger 13 is a battery powered, programmable controller in a small, rugged, sealed module which enables scheduled measurement of the pressure transducer 11, monitoring and recording of user input control signals via the control module 17 and keyboard 19, mathematical computations based upon the measurements and control signals, and storage of recorded and computed data.

The pressure transducer 11 has a range of 0–50 PSI, with an output of 4–20 MA. The quick connect manifold has quick connect fittings for instant installation of the pressure transducer 11 in the manual bounce chamber pressure gauge supply hose 24.

The storage devices 15, and 16 are small, sealed modules which expand the random access memory of the data logger 13 and retain that memory with internal battery power 14 separate from the data logger 13.

The weatherproof control module 17 contains waterproof control switches with large pushbuttons to enable user control of the data logger 13 functions. An indicator lamp 18 is provided on the wiring panel of the data logger 13 to indicate the on/off status of the data logger 13.

The keyboard 19 is a series of pushbutton switches and a display screen to enable user control of the data logger 13 and user monitoring of the status of the data logger 13 and collected data. The telephone modem 20 is a device enabling transfer of data and programming and control of the data logger 13 via telephone by using a personal computer.

The weatherproof storage case 21 is a suitcase-type box, which houses all of the monitor's components, and is fitted with external connectors for the pressure transducer 11 and weatherproof control module 17 to enable use in rainy or inclement weather.

SYSTEM OPERATION

The data logger 13 is controlled by user controlled flags which can be set and cleared by using the keyboard 19, control module 17, or an external personal computer. User controlled flags enable the user to start or stop operation of the data logger 13. When operating, the data logger 13 monitors the pressure transducer 11 signal 64 times per second, converts the signal to pressure (PSI), compares each reading to the previous reading, and retains the highest reading. When the pressure decreases below 5 psi following a reading greater than 5 psi, the retained highest reading is considered to be the peak pressure for the cycle or pulse and is stored with an identification code indicating that the data pertains to a peak pressure data point, the julian day, hour, minute, and seconds. The completed cycle increments a counter called blow/foot, and zeros out the previous peak pressure reading. Operation continues indefinitely until stopped by the user.

A second user controlled flag signals the data logger 13 to indicate completion of a one foot interval of penetration by the Becker Hammer Drill. This signal causes the data logger 13 to increment a counter called a foot counter, and to compute the average and standard deviation of all peak pressure readings since the last time the flag was turned on by the user. The computed data is stored with an identification code indicating that the data pertains to completion of a one foot interval of penetration, along with the julian day, hour, minute, seconds, and battery voltage, and the blows/foot counter is zeroed out. Then the flag is automatically reset.

A third user controlled flag signals the data logger 13 to indicate completion of the drill hole. This signal causes the data logger 13 to zero the foot counter and the blows/foot counter, and to store an identification code indicating that the data pertains to the completion of a drill hole, the julian day, hour, minute, and seconds. Then the flag is automatically reset.

All stored data is retained in the data logger in two separate areas until it overwrites itself, or until the power is interrupted. The data is separated as follows: One area includes only the data recorded for each foot of penetration, and consists of the identification code, the julian day, hour, minute and seconds, standard deviation of the pressure peaks in psi, average pressure of the pressure peaks in psi, number of blows per foot for the completed foot of penetration interval, and foot counter value indicating depth of penetration. The second area includes an identification code, the julian day, hour, minute, and seconds, and peak pressure for every completed pressure cycle, foot counter value indicating depth of penetration, and battery voltage. The identification code is unique depending upon the type of data, whether pressure data for each completed pressure cycle, foot counter increment or completion of drill hole signal.

All data from one area is transferred automatically to the first storage device and from the other area to the second storage device. Data in the storage devices are retained by internal battery power even when the devices are removed from the data logger 13 enabling transport of the devices while the data logger 13 continues to operate. Data in the storage devices can be examined or transferred to a personal computer for import into spreadsheet programs for analysis.

It will be appreciated that the method and apparatus for determining the dynamic characteristics of a soil bed by penetrating a soil bed at a variable penetration rate and measuring the force and displacement of the of the sampling device as a function of time of the present invention, provide certain significant advantages. The principal utility of the invention would be in-situ soil testing and analysis. The general field of application in geotechnical engineering, in-situ testing. The invention would be used by both federal and public agencies and private entities utilizing the Becker Hammer Drill to determine penetration resistance of soils.

Obviously, many modifications and variations of the present invention are possible in light of the above teachings. It is therefore to be understood that within the scope of the appended claims, the invention may be practiced otherwise than as specifically described.

What is claimed is:

1. A system for providing analysis and evaluation of penetration test data produced by measuring cyclical bounce chamber pressure in a bounce chamber of a diesel hammer drill apparatus which delivers a succession of hammer blows to a hammer drill of the apparatus to cause penetration of the drill into a soil bed to be tested, said system comprising:

a pressure transducer operatively connected to said bounce chamber for sensing the bounce chamber pressure and for producing a corresponding pressure measurement, and a data logger for monitoring bounce chamber pressure measurements produced by said pressure transducer a plurality of times during each hammer blow, for selecting a peak pressure measurement for each hammer blow and for computing, for each standard depth interval of the penetration of the hammer drill, an average bounce chamber pressure, said data logger including storage means for storing computed values of said average bounce chamber pressure.

2. The system as claimed in claim 1 wherein said data logger is controlled by a plurality of flags, said flags including a first flag for starting and stopping operation of said data logger, a second flag for signaling said data logger to indicate completion of a one depth interval of the penetration of the hammer drill, and a third flag to indicate completion of a drill hole.

3. A method for providing analysis and evaluation of penetration test data produced by measuring bounce chamber pressure in a bounce chamber of a diesel hammer drill apparatus which delivers a succession of hammer blows to a hammer drill of the apparatus to cause penetration of said drill into a soil bed to be tested, said method comprising the steps of:

(a) measuring the bounce chamber pressure a plurality of times during each hammer blow, and selecting a peak pressure for each hammer blow, (b) storing the peak pressure for each hammer blow along with the date and time of each blow, (c) computing, after the hammer drill has penetrated a standard preselected depth interval, an average bounce chamber pressure for said preselected depth interval, (d) repeating steps (a) to (c) for successive standard preselected depth intervals during penetration of said drill; and (e) storing computed values of said average bounce chamber pressure for access.

4. A system as claimed in claim 3 further comprising computing a standard deviation for each computation of the average bounce chamber pressure.

5. A system as claimed in claim 3 further comprising terminating the operation of the logger after a drill hole of a desired depth has been completed.

6. A system as claimed in claim 5 further comprising a telephone modem for transferring data and for programming and control of said data logger via telephone.

7. A system for providing analysis and evaluation of penetration test data produced by measuring cyclical bounce chamber pressure in a bounce chamber of a diesel hammer drill apparatus which delivers a succession of hammer blows to a hammer drill of the hammer drill apparatus to cause penetration of the drill into a soil bed to be tested, said system comprising:

a pressure transducer operatively connected to said bounce chamber for sensing the bounce chamber pressure and producing a corresponding pressure measurement; and a data logger, connected said pressure transducer, for monitoring the pressure measurements produced by said pressure transducer a plurality of times during each hammer blow, for selecting a peak pressure measurement from said pressure measurements for each hammer blow, and for storing each said selected peak pressure measurement along with the date and time of each corresponding blow.

8. A system as claimed in claim 7 further comprising control means connected to said data logger for producing a control signal indicating that the drill has penetrated a standard depth interval, said data logger, upon receiving said control signal, computing the number of blows and the average and standard deviation of the peak pressure for the previous depth interval.

9. A system as claimed in claim 8 wherein said control means includes a control module, a keyboard, and a display screen.

10. A system as claimed in claim 8 wherein said control means further controls stopping and starting of said data logger.

* * * * *